US008213844B2

(12) United States Patent
Nishikawa et al.

(10) Patent No.: US 8,213,844 B2
(45) Date of Patent: Jul. 3, 2012

(54) DEVELOPING DEVICE AND IMAGE FORMING APPARATUS

(75) Inventors: Tomoharu Nishikawa, Hirakata (JP); Toshiyuki Sakai, Shinshiro (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 349 days.

(21) Appl. No.: 12/541,210

(22) Filed: Aug. 14, 2009

(65) Prior Publication Data

US 2010/0054822 A1 Mar. 4, 2010

(30) Foreign Application Priority Data

Aug. 26, 2008 (JP) ..... 2008-216239

(51) Int. Cl.
*G03G 15/08* (2006.01)

(52) U.S. Cl. ..... 399/286

(58) Field of Classification Search ..... 399/286, 399/119, 227

See application file for complete search history.

(56) References Cited

U.S. PATENT DOCUMENTS 4,200,389 A * 4/1980 Matsui et al. ..... 399/339
5,631,726 A * 5/1997 Sawada ..... 399/111

FOREIGN PATENT DOCUMENTS

JP 05-142875 6/1993
JP 09-103043 4/1997
JP 10-239999 9/1998
JP 2004-338105 A 12/2004

OTHER PUBLICATIONS

Notification of Reasons for Refusal issued in the corresponding Japanese Patent Application No. 2008-216239 dated May 18, 2010, and an English Translation thereof.

* cited by examiner

*Primary Examiner* — David Porta
*Assistant Examiner* — Faye Boosalis
(74) *Attorney, Agent, or Firm* — Buchanan Ingersoll & Rooney PC

(57) ABSTRACT

A developing device for an image forming apparatus of a non-magnetic one-component type. The developing device has a developing roller having a body and a shaft. Bearings for supporting the shaft have a groove made in a contact surface that is in contact with the shaft, and grease is pooled in the groove. The contact surface of the shaft has a surface roughness from 0.2 to 0.5, and the grease has consistency from 265 to 385 (1/10 mm·20° C.).

10 Claims, 4 Drawing Sheets

DEVELOPING DEVICE AND IMAGE FORMING APPARATUS

This application is based on Japanese patent application No. 2008-216239 filed on Aug. 26, 2008, the content of which is incorporated herein.

BACKGROUND OF THE INVENTION

1. Field of the Invention

The present invention relates to developing devices and image forming apparatuses, and more particularly to developing devices and image forming apparatuses of a non-magnetic one-component developing type.

2. Description of Related Art

In a developing device for an image forming apparatus, in order to avoid adhesion of grease to toner, desirably, grease is not applied to bearings of a developing roller. Therefore, as the developing roller, a solid shaft made of metal, such as iron, is used, and the solid shaft is machined such that its both ends to be supported by bearings become narrower than its center for delivering a developer. With this configuration, the developing roller has a smaller inertia, which permits a motor for rotating the developing roller to have a reduced driving torque and which eliminates the necessity of applying grease to the bearings of the developing roller. Additionally, both ends of the developing roller, which are supported by the bearings, are subjected to a mirror surface treatment so that friction between the bearings and the both ends of the developing roller can be reduced, which eliminates the necessity of applying grease to the bearings of the developing roller. Moreover, as the bearings, for example, ball bearings are used, which reduces the friction between the both ends of the developing roller and the bearings and which eliminates the necessity of applying grease to the bearings of the developing roller.

Image forming apparatuses of a non-magnetic one-component developing type are simpler than image forming apparatuses of a two-component developing type and are mostly used for inexpensive systems. Therefore, it is especially demanded that developing devices to be employed in image forming apparatuses of a non-magnetic one-component developing type be manufactured at low cost. As will be described in the following, however, various trials to reduce the manufacturing cost of developing devices result in an increase of the driving torque of the motor for rotating the developing roller.

Specifically, in order to reduce the manufacturing cost, for example, resin bearings, instead of the ball bearings, may be used. In this case, however, the developing roller has larger friction between its both ends and the resin bearings when rotating, compared with the case of using the ball bearings, and the motor for rotating the developing roller is required to have a larger driving torque.

Another way of reducing the manufacturing cost may be using an inexpensive aluminum hollow pipe, instead of the iron solid shaft, as the developing roller. In this case, the aluminum pipe is subjected to drawing such that its both ends to be supported by bearings become narrower than its center for delivering a developer and is subjected to machining for shaping, so that the aluminum developing roller has a reduced inertia.

It is, however, difficult to narrower the both ends of the aluminum pipe by drawing, compared with the case of narrowing the both ends of the solid developing roller by machining. Therefore, the aluminum pipe developing roller has a larger inertia and accordingly requires the motor to have a larger driving torque, compared with the solid developing roller.

Further, in order to reduce the manufacturing cost, the both ends of the aluminum pipe developing roller are subjected to machining but are not subjected to a mirror surface treatment or superoll processing. Therefore, the surface roughness of the aluminum pipe developing roller is higher than that of a developing roller subjected to a mirror surface treatment or superoll processing. Accordingly, the aluminum pile developing roller has larger friction between its both ends and the bearings than a developing roller subjected to a mirror surface treatment or superoll processing. Consequently, the motor is required to have a larger driving torque.

As described above, combination of various measures to reduce the manufacturing cost of the developing device results in an increase in the driving torque of the motor. When an inexpensive motor is used for rotating the developing roller, the motor may come into step-out due to its insufficient driving torque. As well as the step-out of the motor, the connection between the motor and the developing roller may be out of gear. In order to avoid such trouble, in a developing device with the above-described measures to reduce the manufacturing cost taken, it is necessary to apply grease to between the bearings and the both ends of the developing roller.

On the other hand, even if grease is applied to between the bearings and the both ends of the developing roller, the grease will be used out as the developing device is used. The use-out of grease increases the friction between the bearings and the developing roller, which requires the motor to have a larger driving torque. Consequently, the motor may come into step-out, and/or the connection between the motor and the developing roller may be out of gear.

Known examples having a structure for preventing use-out of grease between a shaft and bearings are a motor disclosed by Japanese Patent Laid-Open Publication No. 9-103043 and a recorder disclosed by Japanese Patent Laid-Open Publication No. 2004-338105. More specifically, Japanese Patent Laid-Open Publication No. 9-103043 and Japanese Patent Laid-Open Publication No. 2004-338105 disclose that a groove is made in the shaft and that grease is pooled in the groove. Japanese Patent Laid-Open Publication No. 9-103043 relates to a motor, and Japanese Patent Laid-Open Publication No. 2004-338105 relates to a recorder. Thus, these publications relate to technical fields totally different from the field of the present invention, i.e., the field of developing devices, and neither of these publications describes measures to prevent use-out of grease.

SUMMARY OF THE INVENTION

An object of the present invention is to provide a developing device and an image forming apparatus wherein the necessity of increasing the driving torque of a motor is suppressed.

The present invention relates to a developing device for an image forming apparatus of a non-magnetic one-component developing type, and a developing device according to an embodiment of the present invention comprises: a rotary member having a rotary shaft; and a bearing having a contact surface that is in contact with the rotary shaft, a groove for pooling grease therein being made in the contact surface. In the developing device, the rotary shaft has a surface roughness Ra from 0.2 to 0.5 at a portion in contact with the contact surface of the bearing, and grease having consistency from 265 to 385 (1/10 mm·20° C.) is applied to between the contact surface of the bearing and the rotary shaft.

The present invention also relates to an image forming apparatus of a non-magnetic one-component developing type, and an image forming apparatus according to an embodiment of the present invention comprises a developing device comprising: a rotary member having a rotary shaft; and a bearing having a contact surface that is in contact with the rotary shaft, a groove for pooling grease therein being made in the contact surface. In the developing device, the rotary shaft has a surface roughness Ra from 0.2 to 0.5 at a portion in contact with the contact surface of the bearing, and grease having consistency from 265 to 385 (1/10 mm·20° C.) is applied to between the contact surface of the bearing and the rotary shaft.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An embodiment of the present invention is a developing device for an image forming apparatus of a non-magnetic one-component type, and the developing device comprises a rotary member having a rotary shaft; and a bearing having a contact surface that is in contact with the rotary shaft, a groove for pooling grease therein being made in the contact surface. In the developing device, the rotary shaft has a surface roughness Ra from 0.2 to 0.5 at a portion in contact with the contact surface of the bearing, and grease having consistency from 265 to 385 (1/10 mm·20° C.) is applied to between the contact surface of the bearing and the rotary shaft.

In the developing device, a groove is made in the bearing, the rotary shaft has a surface roughness Ra from 0.2 to 0.5 at the portion in contact with the shaft, and grease having consistency from 265 to 385 (1/10 mm·20° C.) is applied to between the contact surface of the bearing and the rotary shaft. Thereby, the driving torque required of a motor for rotating the rotary member of the developing device can be reduced.

Another embodiment of the present invention is an image forming apparatus of a non-magnetic one-component developing type, and the image forming apparatus comprises a developing device comprising: a rotary member having a rotary shaft; and a bearing having a contact surface that is in contact with the rotary shaft, a groove for pooling grease therein being made in the contact surface. In the developing device, the rotary shaft has a surface roughness Ra from 0.2 to 0.5 at a portion in contact with the contact surface of the bearing, and grease having consistency from 265 to 385 (1/10 mm·20° C.) is applied to between the contact surface of the bearing and the rotary shaft.

Structure of Image Forming Apparatus

Figure 1:
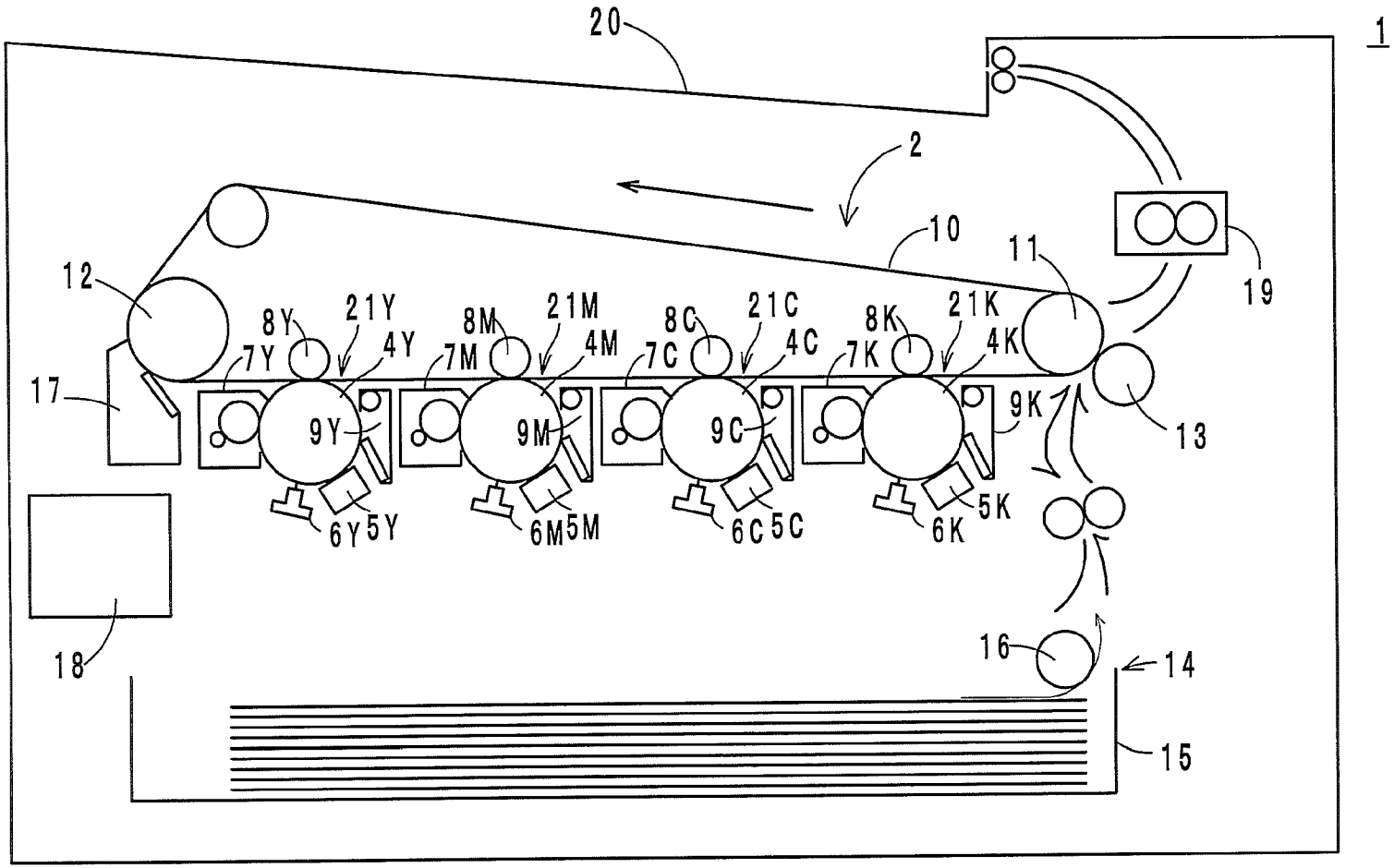
FIG. 1 is a schematic view of an image forming apparatus according to an embodiment of the present invention.
Figure 2:
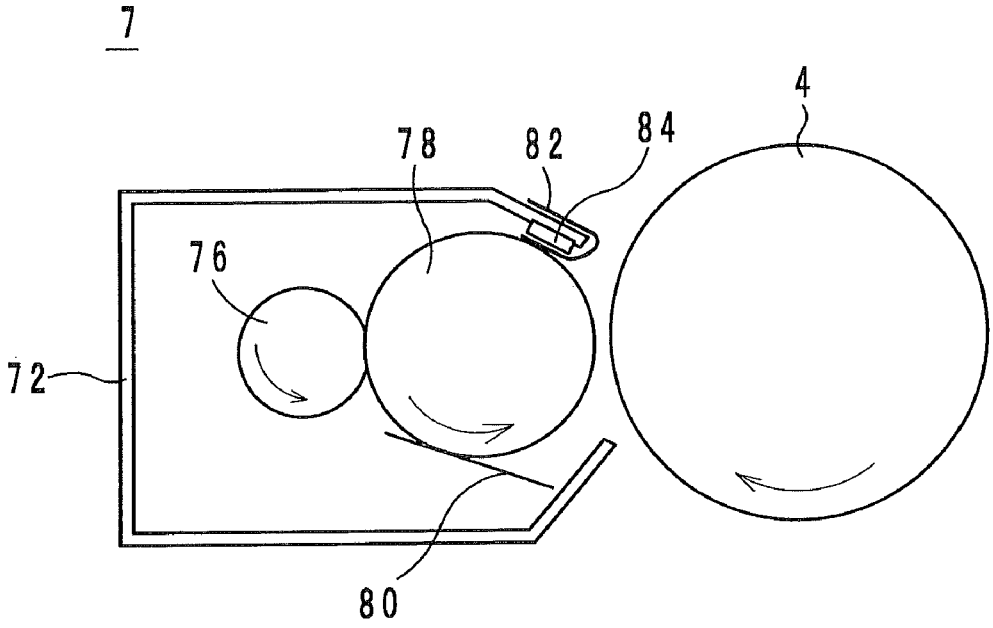
FIG. 2 is a sectional view of a developing device employed in the image forming apparatus shown by FIG. 1.

In the following, a developing device and an image forming apparatus according to an embodiment of the present invention are described with reference to the accompanying drawings. The image forming apparatus is a color image forming apparatus of a non-magnetic non-contact one-component type. FIG. 1 shows the general structure of the image forming apparatus 1. FIG. 2 is a sectional view of a developing device 7.

The image forming apparatus 1 shown by FIG. 1 is an electrophotographic color printer of a so-called tandem type, wherein images of four colors (Y: yellow, M: magenta, C: cyan, K: black) are formed and combined with one another. The image forming apparatus 1 receives an input of a print job and forms images on print medium, such as paper. The image forming apparatus 1 comprises a printing section 2, a sheet feeding section 14, a control section 18, a fixing device 19 and a printed-sheet tray 20.

The control section 18 is, for example, a CPU and functions as a controller for controlling the printing section 2, the feeding section 14 and the fixing device 19. The sheet feeding section 14 is to feed sheets one by one and comprises a sheet tray 15 and a feed roller 16. On the sheet tray 15, plural sheets before subjected to printing are stacked. The feed roller 16 feeds the stacked sheets out of the tray 15 one by one.

The printing section 2 is to form a toner image on a sheet fed from the sheet feeding section 14. The printing section 2 comprises image forming units 21Y, 21M, 21C and 21K, first transfer rollers 8Y, 8M, 8C and 8K, a transfer belt 10, a driving roller 11, a driven roller 12, a transfer roller 13 and a cleaning device 17. The image forming units 21Y, 21M, 21C and 21K comprise photosensitive drums 4Y, 4M, 4C and 4K, chargers 5Y, 5M, 5C and 5K, exposure devices 6Y, 6M, 6C and 6K, developing devices 7Y, 7M, 7C and 7K, and cleaners 9Y, 9M, 9C and 9K, respectively. In the following paragraphs, the photosensitive drums 4, the chargers 5, the exposure devices 6, the developing devices 7, the first transfer rollers 8, the cleaners 9 and the image forming units 21 generally mean the photosensitive drums, the chargers, the exposure devices, the developing devices, the first transfer rollers, the cleaners and the image forming units, respectively. The photosensitive drums 4Y, 4M, 4C and 4K, the chargers 5Y, 5M, 5C and 5K, the exposure devices 6Y, 6M, 6C and 6K, the developing devices 7Y, 7M, 7C and 7K, the first transfer rollers 8Y, 8M, 8C and 8K, the cleaners 9Y, 9M, 9C and 9K, and the image forming units 21Y, 21M, 21C and 21K mean the individual photosensitive drums, the individual chargers, the individual exposure devices, the individual developing devices, the individual first transfer rollers, the individual cleaners and the individual image forming units, respectively.

The chargers 5 charge the circumferences of the photosensitive drums 4. The exposure devices 6 emit lasers controlled by the control section 18. Thereby, electrostatic latent images are formed on the circumferences of the photosensitive drums 4. Thus, the chargers 5 and the exposure devices 6 function as electrostatic latent image forming means for forming electrostatic latent images on the circumferences of the photosensitive drums 4.

As FIG. 2 shows, each of the developing devices 7 comprises a developer bath 72, a supply roller 76, a developing roller 78, a regulator blade 80, an electro-eraser sheet 82 and a presser 84. At a specified distance from the developing roller 78, the corresponding photosensitive drum 4 is located such that the photosensitive drum 4 does not come into contact with the developing roller 78. The developing devices 7 function as developing means for supplying toner to the photosensitive drums 4 to form toner images on the circumferences of the photosensitive drums 4. The developing devices 7 will be described in more detail below.

The developer bath 72 contains a one-component non-magnetic developer, i.e., toner and holds the supply roller 76, the developing roller 78, the regulator blade 80, the electro-erasure sheet 82 and the presser 84. The supply roller 76 rotates counterclockwise in FIG. 2 to supply toner to the developing roller 78. More specifically, toner sticks to the circumference of the supply roller 76, and the supply roller 76 and the developing roller 78 are in contact with each other. Therefore, toner friction occurs at the contact point between the supply roller 76 and the developing roller 78, whereby toner is charged negative. Because the developing roller 78 is impressed with a higher voltage than the supply roller 76, the negative-charged toner moves from the supply roller 76 to the developing roller 78 at the contact point.

The edge of the regulator blade 80 is pressed against the developing roller 78. Thereby, a toner layer with a specified thickness is formed on the circumference of the developing roller 78. As shown in FIG. 2, the developing roller 78 rotates counterclockwise and delivers toner toward the photosensitive drum 4. The electrostatic latent image formed on the photosensitive drum 4 is of a higher voltage than the developing roller 78. Therefore, at the position where the developing roller 78 and the photosensitive drum 4 are opposite to each other, the negative-charged toner moves from the developing roller 78 to the photosensitive drum 4. Thereby, a toner image is formed on the circumference of the photosensitive drum 4. The presser 84 is, for example, an elastic sponge and presses the electro-eraser sheet 82 against the developing roller 78. The electro-eraser sheet 82 erases the static electricity of toner remaining on the developing roller 78. Thereby, after passing the position where the developing roller 78 and the photosensitive drum 4 are opposite to each other, the toner is returned into the developer bath 72 by the supply roller 76.

The transfer belt 10 is bridged between the driving roller 11 and the driven roller 12 and functions as a transfer medium onto which toner images formed on the photosensitive drums 4 are transferred first. The first transfer rollers 8 are located in positions to come into contact with the inner surface of the transfer belt 10 and transfers the toner images formed on the photosensitive drums 4 onto the transfer belt 10. After the first transfer, the cleaners 9 remove and retrieve residual toner from the circumferences of the photosensitive drums 4. The driving roller 11 is rotated by a power source such as a motor (not shown) and drives the transfer belt 10. With the drive of the transfer belt 10, the toner images are fed to the transfer roller 13. The transfer roller 13 transfers the toner images to a sheet fed from the sheet feeding section 14 (second transfer). After the second transfer of the toner images to the sheet, the cleaning device 17 removes residual toner from the transfer belt 10.

The sheet subjected to the second transfer is then fed to the fixing device 19. The fixing device 19 functions as fixing means that performs a heating treatment and a pressing treatment toward a sheet to fix a toner image on the sheet. The printed sheet is ejected onto the printed-sheet tray 20.

Structure of Developing Roller

Figure 3:
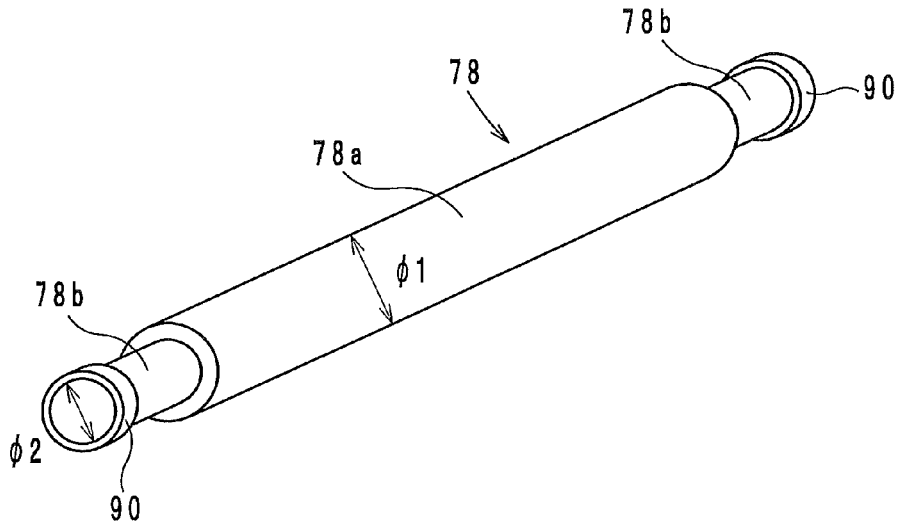
FIG. 3 is a perspective view of a developing roller and bearings.
Figure 4A:
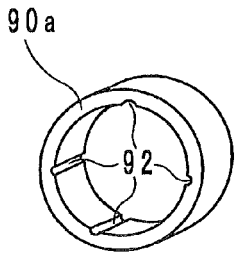
FIGS. 4*a*, 4*b* and 4*c* are perspective views of three types of bearings.
Figure 4B:
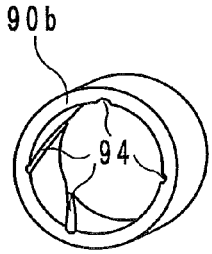
Figure 4C:
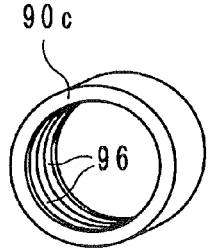

Next, the structure of the developing roller 78 is described with reference to the drawings. FIG. 3 is a perspective view of the developing roller 78 and bearings 90. FIGS. 4*a*, 4*b* and 4*c* are perspective views of three types of bearings 90*a*, 90*b* and 90*c*.

As FIG. 3 shows, the developing roller 78 comprises a body 78*a* and a shaft 78*b*. The body 78*a* is a cylinder with an outer diameter of ϕ1. Since the body 78*a* is impressed with a higher voltage than the supply roller 76, the body 78*a* holds negative-charged toner on the circumference, and the body 78*a* is rotated to deliver the toner toward the photosensitive drum 4.

The shaft 78*b*, which is a cylinder with an outer diameter of ϕ2 smaller than ϕ1, is located to stick out from both ends of the body 78*a*. Both ends of the shaft 78*b* are inserted in the bearings 90 that are located in the developer bath 72 (not shown in FIG. 3), so that the shaft 78*b* is supported to be rotatable. Additionally, a motor (not shown) is connected to the shaft 78*b* via gears. In this structure, the developing roller 78 is driven to rotate by the motor.

The developing roller 78, which comprises the body 78*a* and the shaft 78*b*, is made of an inexpensive aluminum hollow pipe so as to reduce the manufacturing costs of the developing devices 7 and the image forming apparatus 1. More specifically, the shaft 78*b* is made by drawing both ends of a pipe with a uniform outer diameter and by machining the both ends of the pipe for shaping.

When the developing roller 78 is made of an aluminum pipe, even if grease is applied to between the bearings 9 and the shaft 78*b*, the grease will be used out as the developing roller 78 is used for a long time. Consequently, a large driving torque will be necessary to rotate the developing roller 78. Also, when resin bearings are used as the bearings 90, the friction between the shaft 78*b* and the bearings 90 becomes large, and a large driving torque is necessary to rotate the developing roller 78.

In order to avoid such trouble, the developing device 7 according to this embodiment has the following features: the bearings 90 are resin and have grooves made in the respective surfaces to come into contact with the shaft 78*b*; and the surface roughness Ra of the shaft 78*b* and the consistency of the grease are regulated. The consistency is a value indicating the hardness of grease. A large value of consistency shows that the grease is soft, and a small value of consistency shows that the grease is hard.

As FIGS. 4*a*, 4*b* and 4*c* show, the developing device 7 according to this embodiment may use the bearings 90*a*, 90*b* and 90*c*, which have grooves 92, 94 and 96, respectively, on their respective inner surfaces to come into contact with the shaft 78*b*. More specifically, the bearing 90*a* shown by FIG. 4*a* has, on its inner surface, plural grooves 92 extending in parallel to the extending direction of the shafts 78*b*. The bearing 90*b* shown by FIG. 4*b* has, on its inner surface, plural grooves 94 extending in a slantwise direction not in parallel to the extending direction of the shaft 78*b*. The bearing 90*c* shown by FIG. 4*c* has, on its inner surface, plural grooves 96 in the form of rings in planes perpendicular to the extending direction of the shaft 78*b*.

A type of bearings selected from the bearings 90*a*, 90*b* and 90*c* shown by FIGS. 4*a*, 4*b* and 4*c* is used for the developing device 7 according to this embodiment. The grooves 92, 94 and 96 made in the bearings 90*a*, 90*b* and 90*c* are to keep grease therein. Excess grease at the interfaces between the bearings 90 and the shaft 78*b* is kept in the grooves 92, 94 or 96 without being pushed out from between the bearings 90 and the shaft 78*b*. Then, the grease kept in the grooves 92, 94 or 96 is gradually consumed as the developing roller 78 rotates. Thus, the grooves 92, 94 or 96 inhibit use-out of the grease. Consequently, the motor for rotating the developing roller 78 is required to have only a reduced driving torque. The numbers of the grooves 92, 94 and 96 are at least one and are preferably within a range from two to four.

In the developing device 7 according to this embodiment, the surface roughness Ra of the portions of the shaft 78*b* to be in contact with the bearings 90 is in a range from 0.1 to 0.5. By limiting the surface roughness Ra of the shaft 78*b*, the friction between the bearings 90 and the shaft 78*b* can be reduced, and the driving torque of the motor for rotating the developing roller 78 can be reduced.

More specifically, if the surface roughness Ra of the shaft 78*b* is less than 0.1, the bearings 90 adhere to the shaft 78*b*. In this case, large friction occurs between the shafts 78*b* and the bearings 90, and there is almost no space between the shaft 78*b* and the bearings 90. Therefore, as the developing roller 78 is rotating, the grease is pushed out from between the shaft 78*b* and the bearings 90. In this way, as the developing device 7 is used for a long time, the grease is used out, and the friction between the shaft 78*b* and the bearings 90 becomes larger.

On the other hand, if the surface roughness Ra of the shaft 78*b* is greater than 0.5, the shaft 78*b* scrapes against the inner surfaces of the bearings 90, and scraps of the bearings 90 are mixed into the grease. Then, as the developing roller 78 continues further rotating, the inner surfaces of the bearings 90 are further scraped by the shaft 78*b* and the scraps. Consequently, the friction between the shaft 78*b* and the bearings 90 becomes larger. For the reasons above, the surface roughness Ra of the shaft 78*b* is preferably from 0.1 to 0.5.

In the developing device 7 according to this embodiment, further, the consistency of the grease is from 265 to 385 (1/10 mm 20° C.). By limiting the consistency of the grease, the driving torque of the motor for rotating the developing roller 78 can be reduced, and the grease is prevented from adhering to the toner and/or the photosensitive drum 4.

More specifically, if the consistency of the grease is less than 265 (1/10 mm·20° C.), the grease is hard. Especially under low temperature and low humidity, the slidability of the shaft 78*b* against the bearings 90 becomes low. Consequently, the motor for rotating the developing roller 78 is required to have a large driving torque.

If the consistency of the grease is greater than 385 (1/10 mm·20° C.), the grease is soft. Especially under high temperature and high humidity, the grease becomes fluid, and as the developing roller 78 is rotating, the grease splashes out from between the shaft 78*b* and the bearings 90. Consequently, the grease adheres to the toner and the photosensitive drum 4, and the printing performance of the image forming apparatus 1 is degraded, which causes image noise. For the reasons above, the consistency of the grease is preferably from 265 to 385 (1/10 mm·20° C.).

In the developing device 7 according to the present invention, further, the outer diameter $\phi$2 of the shaft 78*b* is preferably from 0.75 to 1.0 times the outer diameter $\phi$1 of the body 78*a*. That the outer diameter $\phi$2 of the shafts 78*b* is greater than 1.0 times the outer diameter $\phi$1 of the body 78*a* means that the shaft 78*b* is thicker than the body 78*a*, which is not normal in the design of the developing roller 78. If the outer diameter $\phi$2 of the shaft 78*b* is less than 0.75 times the outer diameter $\phi$1 of the body 78*a*, the inertia of the developing roller 78 is small enough. Therefore, without making grooves on the surfaces of the bearings 90 to come into contact with the shaft 78*b* and without limiting the surface roughness of the shaft 78*b* and the consistency of the grease, the driving torque of the motor for rotating the developing roller 78 can be reduced to such a degree not to cause out-of-gear and step-out of the motor.

Results of Experiment

The inventors conducted an experiment so as to confirm the advantages of the developing device 7 according to this embodiment. More specifically, 23 samples of the developing device 7, of which specifications are shown by Table 1, were fabricated, and these samples of the developing device 7 were set in full-color printers "Magicolor 2430" made by Konica Minolta Co., Ltd. Then, by using each of the printers, an endurance test was conducted. Specifically, a chart image with 5% coverage was printed on 4500 sheets continuously, and in the meantime, the driving torque required for rotating the developing roller 78 was measured at the time of printing 0 sheets, at the time of printing 2000 sheets and at the time of printing 4500 sheets.

Table 1 shows the specifications of the samples, and more particularly shows the surface roughness Ra of the shaft 78*b*, the type of the bearings 90, the number of grooves made in each of the bearings 90, and the degree of consistency (consistency number), the consistency and the model number of the grease. The surface roughness Ra was measured by SURFCOM 480A made by TOKYO SEIMITSU CO., LTD. under the following conditions.

Inclination Offset: R Surface
Filter Selection: Gaussian
$\lambda$s Filter: Not Used
Calculation Standard: JIS82'
Measurement Distance: 10 mm
Measurement Speed: 0.3 mm/s
Cut-off Value: 0.8 mm
Measurement Range: 40 μm In Table 1, the degree of consistency corresponds to the consistency number of the model number of the used grease (under JIS). The values shown as consistency in Table 1 are values shown in the respective catalogs of the models of grease, and the values were calculated by the method of JISK2220.

TABLE 1

| | SHAFT 78b | BEARINGS 90 | | GREASE | | |
|---|---|---|---|---|---|---|
| SAMPLE | SURFACE ROUGHNESS Ra | BEARING TYPE | NO. OF GROOVES | CONSISTENCY RANGE (CONSISTENCY #) | CONSISTENCY | MODEL NO. |
| 1 | 0.32 | BEARING 90a | 3 | 265-295 (#2) | 270 | MOLYKOTE PG-662 |
| 2 | 0.32 | BEARING 90b | 3 | 310-340 (#1) | 325 | MOLYKOTE EM-60L |
| 3 | 0.32 | BEARING 90c | 3 | 355-385 (#0) | 380 | MOLYKOTE EM-D110 |
| 4 | 0.46 | BEARING 90b | 2 | 265-295 (#2) | 270 | MOLYKOTE PG-662 |
| 5 | 0.46 | BEARING 90c | 3 | 310-340 (#1) | 325 | MOLYKOTE EM-60L |
| 6 | 0.46 | BEARING 90a | 4 | 355-385 (#0) | 380 | MOLYKOTE EM-D110 |
| 7 | 0.24 | BEARING 90c | 2 | 265-295 (#2) | 270 | MOLYKOTE PG-662 |
| 8 | 0.24 | BEARING 90a | 3 | 310-340 (#1) | 325 | MOLYKOTE EM-60L |
| 9 | 0.24 | BEARING 90b | 4 | 355-385 (#0) | 380 | MOLYKOTE EM-D110 |
| 10 | 0.13 | BEARING 90a | 3 | 265-295 (#2) | 270 | MOLYKOTE PG-662 |

TABLE 1-continued

| | SHAFT 78b | BEARINGS 90 | | GREASE CONSISTENCY | | |
|---|---|---|---|---|---|---|
| SAMPLE | SURFACE ROUGHNESS Ra | BEARING TYPE | NO. OF GROOVES | RANGE (CONSISTENCY #) | CONSISTENCY | MODEL NO. |
| 11 | 0.13 | BEARING 90a | 3 | 310-340 (#1) | 325 | MOLYKOTE EM-60L |
| 12 | 0.13 | BEARING 90a | 3 | 355-385 (#0) | 380 | MOLYKOTE EM-D110 |
| 13 | 0.55 | BEARING 90a | 3 | 265-295 (#2) | 270 | MOLYKOTE PG-662 |
| 14 | 0.55 | BEARING 90a | 3 | 310-340 (#1) | 325 | MOLYKOTE EM-60L |
| 15 | 0.55 | BEARING 90a | 3 | 355-385 (#0) | 380 | MOLYKOTE EM-D110 |
| 16 | 0.46 | BEARING 90a | 3 | 220-250 (#3) | 240 | MOLYKOTE HIGH VACUUM |
| 17 | 0.32 | BEARING 90a | 3 | 220-250 (#3) | 240 | MOLYKOTE HIGH VACUUM |
| 18 | 0.24 | BEARING 90a | 3 | 220-250 (#3) | 240 | MOLYKOTE HIGH VACUUM |
| 19 | 0.46 | BEARING 90a | 3 | 400-430 (#00) | 410 | OMEGA MODEL 27 |
| 20 | 0.32 | BEARING 90a | 3 | 400-430 (#00) | 410 | OMEGA MODEL 27 |
| 21 | 0.24 | BEARING 90a | 3 | 400-430 (#00) | 410 | OMEGA MODEL 27 |
| 22 | 0.32 | — | 0 | 310-340 (#1) | 325 | MOLYKOTE EM-60L |
| 23 | 0.32 | BEARING 90a | 3 | — | — | — |

The samples were evaluated into five grades. More specifically, the driving torque for rotating the developing roller 78 before starting printing (i.e. at the time of printing 0 sheets) was used as an initial value, and in accordance with the increase ratio of the driving torque after starting printing to the initial value, the five-grade evaluation was made. After the five-grade evaluation, the samples graded with "5" or "4" were judged to be good, and the samples graded with "3" or less were judged to be defective.

TABLE 2

| Grade | State |
|---|---|
| 5 | ratio of driving torque increase to initial value ≦ 10% |
| 4 | 10% < ratio of driving torque increase to initial value ≦ 20% |
| 3 | 20% < ratio of driving torque increase to initial value ≦ 40% |
| 2 | ratio of driving torque increase to initial value > 40% |
| 1 | out-of-gear or step-out of motor occurred |

Moreover, after 1000 sheets were printed under high temperature and high humidity, it was judged whether image noise occurred.

Figure 5:
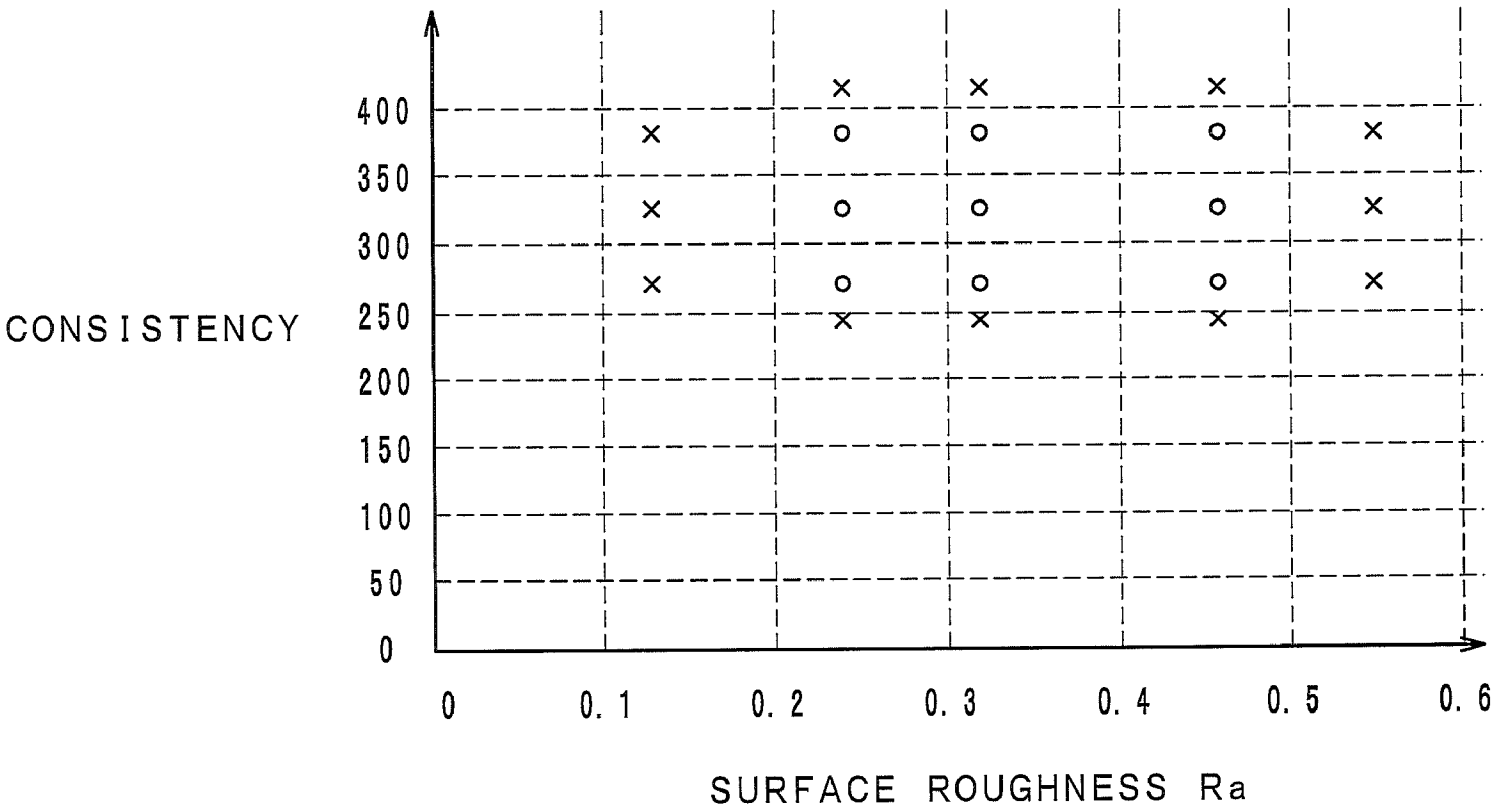
FIG. 5 is a graph showing results of an experiment with respect to Sample 1 to Sample 21 shown in Table 3.

Table 3 shows the results of the experiment. FIG. 5 is a graph showing the specifications and the experiment results of Samples 1-21 in Table 3. The y-axis shows the consistency, and the x-axis shows the surface roughness Ra. Plots by circles in the graph of FIG. 5 denote samples graded with "4" or "5", and plots by crosses in the graph of FIG. 5 denote samples graded with "3" or less and samples wherein image noise occurred. FIG. 5 does not show Sample 22, which has bearings with no grooves made therein, and Sample 23, which is not coated with grease.

TABLE 3

| | Grade | | Occurrence of |
|---|---|---|---|
| Sample | 2000 sheets | 4500 sheets | Image Noise |
| 1 | 5 | 4 | No |
| 2 | 5 | 5 | No |
| 3 | 5 | 5 | No |
| 4 | 5 | 5 | No |
| 5 | 5 | 5 | No |
| 6 | 5 | 5 | No |

TABLE 3-continued

| | Grade | | Occurrence of |
|---|---|---|---|
| Sample | 2000 sheets | 4500 sheets | Image Noise |
| 7 | 4 | 4 | No |
| 8 | 5 | 4 | No |
| 9 | 5 | 5 | No |
| 10 | 2 | 1 | No |
| 11 | 3 | 2 | No |
| 12 | 4 | 2 | No |
| 13 | 3 | 2 | No |
| 14 | 4 | 2 | No |
| 15 | 4 | 2 | No |
| 16 | 2 | 1 | No |
| 17 | 2 | 2 | No |
| 18 | 2 | 1 | No |
| 19 | 5 | 5 | Occurred |
| 20 | 5 | 5 | Occurred |
| 21 | 5 | 5 | Occurred |
| 22 | 3 | 1 | No |
| 23 | 2 | 1 | No |

As shown in Table 3, Samples 1-9 and 19-21 were graded with "4" or "5" both at the time of printing 2000 sheets and at the time of printing 4500 sheets. The other samples were graded with "3" or less at the time of printing 2000 sheets and/or at the time of printing 4500 sheets. Although Samples 19-21 were graded with "5", image noise occurred in these samples. Accordingly, Samples 1-9 were judged to be good, and Samples 10-23 were judged to be defective.

FIG. 5 is a graph wherein these results are plotted. As is apparent from the graph of FIG. 5, Samples 1-9, which were judged to be good, have consistency from 270 to 380 (1/10 mm·20° C.) and surface roughness Ra from 0.24 to 0.46. Therefore, when the consistency of the grease is from 270 to 380 (1/10 mm·20° C.) and when the surface roughness Ra of the shaft 78*b* is 0.24 to 0.46, the necessity of increasing the driving torque of the motor for rotating the developing roller 78 after printing 4500 sheets can be satisfactorily suppressed.

As shown in Table 1, the consistency numbers of the grease used in Samples 1-9, which were judged to be good, are 0, 1 and 2. Any other kinds of grease than those shown in FIG. 1, as long as they are of consistency numbers 0, 1 or 2, can suppress the necessity of increasing the driving torque of the motor for rotating the developing roller 78. In other words, the consistency of the grease to be used shall be from 265 to 385 (1/10 mm·20° C.).

As mentioned, the surface roughness Ra of the shaft 78*b* shall be from 0.24 to 0.46. However, as will be described below, in order to suppress the necessity of increasing the driving torque of the motor for rotating the developing roller 78, the surface roughness Ra may be within a range from 0.2 to 0.5. In the experiment, the samples wherein the surface roughness Ra of the shaft 78*b* are 0.13 were judged to be defective, and the samples wherein the surface roughness Ra of the shafts 78*b* are 0.55 were judged to be defective. Thus, it is inferred that the surface roughness Ra defining the borders between good and defective is between 0.13 and 0.24 and between 0.46 and 0.55. Therefore, the inventors determined the lower limit of the surface roughness Ra to be substantially the midpoint between 0.13 and 0.24, i.e., 0.2. Likewise, the inventors determined the upper limit of the surface roughness Ra to be substantially the midpoint between 0.46 and 0.55, i.e., 0.5.

The above-described endurance test was conducted to a yellow developing device, a magenta developing device and a cyan developing device in a full-color printer, and the same results as described above were obtained in all the developing devices.

In the embodiment above, the present invention is applied to a developing roller. However, the present invention is also applicable to the supply roller.

Although the present invention has been described in connection with the preferred embodiment above, it is to be noted that various changes and modifications are possible to those who are skilled in the art. Such changes and modifications are to be understood as being within the scope of the present invention.

What is claimed is:

1. A developing device for an image forming apparatus of a non-magnetic one-component developing type, said developing device comprising:

a rotary member having a rotary shaft; and a bearing having a contact surface that is in contact with the rotary shaft, a groove for pooling grease therein being made in the contact surface, wherein the rotary shaft has a surface roughness Ra from 0.2 to 0.5 at a portion in contact with the contact surface of the bearing; and wherein grease having consistency from 265 to 385 (1/10 mm·20° C.) is applied to between the contact surface of the bearing and the rotary shaft.

2. A developing device according to claim 1, wherein the rotary member is a developing roller.

3. A developing device according to claim 2, wherein an outer diameter of the rotary shaft is 0.75 to 1.0 times that of a developer delivering portion of the developing roller.

4. A developing device according to claim 1, wherein the rotary member is made of aluminum.

5. A developing device according to claim 1, wherein the rotary member is a hollow pipe.

6. An image forming apparatus of a non-magnetic one-component developing type comprising:

a developing device comprising:

a rotary member having a rotary shaft; and a bearing having a contact surface that is in contact with the rotary shaft, a groove for pooling grease therein being made in the contact surface, wherein the rotary shaft has a surface roughness Ra from 0.2 to 0.5 at a portion in contact with the contact surface of the bearing; and wherein grease having consistency from 265 to 385 (1/10 mm·20° C.) is applied to between the contact surface of the bearing and the rotary shaft.

7. An image forming apparatus according to claim 6, wherein the rotary member of the developing device is a developing roller.

8. An image forming apparatus according to claim 7, wherein an outer diameter of the rotary shaft of the developing device is 0.75 to 1.0 times that of a developer delivering portion of the developing roller.

9. An image forming apparatus according to claim 6, wherein the rotary member of the developing device is made of aluminum.

10. An image forming apparatus according to claim 6, wherein the rotary member of the developing device is a hollow pipe.

* * * * *